US005535512A

United States Patent [19]

Armogan

[11] Patent Number: 5,535,512

[45] Date of Patent: Jul. 16, 1996

[54] METHOD OF MAKING A HERMETICALLY SEALED ELECTRICAL CONNECTOR

[76] Inventor: Lloyd Armogan, 13172 Bittersweet St., NW., Coon Rapids, Minn. 55448

[21] Appl. No.: 322,178

[22] Filed: Oct. 12, 1994

[51] Int. Cl.[6] ..... H01R 43/02; H01R 13/40; H01R 43/00

[52] U.S. Cl. ..... 29/877; 29/884; 439/589; 439/936

[58] Field of Search ..... 29/884, 877, 878; 439/589, 935, 936

[56] References Cited

U.S. PATENT DOCUMENTS

| | | | |
|---|---|---|---|
| 3,522,575 | 8/1970 | Watson et al. . | |
| 3,568,131 | 3/1971 | Kennedy | 439/155 |
| 4,775,333 | 10/1988 | Grider et al. . | |
| 4,793,060 | 12/1988 | Pretchel . | |
| 4,913,673 | 4/1990 | Kobler . | |
| 4,921,449 | 5/1990 | Fish | 439/585 |
| 4,976,634 | 12/1990 | Green et al. . | |
| 5,044,992 | 9/1991 | Dzwonczyk et al. . | |
| 5,060,108 | 10/1991 | Baker et al. . | |

OTHER PUBLICATIONS

*Hermetically Sealed Automotive Connector,* Interconnection Technology, Feb. 1993, pp. 28–31.

*Microminiature Connectors,* ITT Cannon, pp. 10–26.

*Primary Examiner*—P. W. Echols

*Attorney, Agent, or Firm*—Kinney & Lange

[57] ABSTRACT

An electrical connector having a metallic housing about an insulative insert is hermetically sealed. Both the seal area of the housing and the seal surface of the insulative insert are roughened and cleaned. The seal area of the housing is primed with a primer which is dried prior to assembly of the insert and the electrically conductive contacts within the housing. The assembled connector is pre-heated, and a sealant is applied to the seal area of the housing and the seal surface of the insulative insert around the electrically conductive pins. The preferred sealant is an alumina-filled or aluminum nitride-filled epoxy based resin, mixed with a catalyst and a reactive diluent and degassed in a vacuum. The sealant is applied to the connector and allowed to set-up prior to curing at an elevated temperature.

17 Claims, 2 Drawing Sheets

METHOD OF MAKING A HERMETICALLY SEALED ELECTRICAL CONNECTOR

BACKGROUND OF THE INVENTION

This invention relates to electrical connectors, and more particularly to a method of hermetically sealing electrical connectors particularly appropriate for electrical connectors having a metal housing and an insulative insert supporting one or more conductive contacts.

Various structures have been developed as electrical connectors to allow ready attachment and detachment of wires between electrical devices. Many electrical connectors include a plug and a receptacle. The plug includes one or more electrically conductive male contacts or pins, and the receptacle includes a similar number of female electrically conductive contacts. The male contacts on the plug are permanently electrically connected to wires or "leads" for use in the plug device, and the female contacts on the receptacle are permanently electrically connected to wires or leads of the receptacle device. Either the plug or the receptacle is generally mounted on a wall or secure structure, although on some occasions both the plug and the receptacle will merely be on the end of a cord. Electrical connection is easily achieved by pushing the male contacts on the plug into the receptacle, and disconnection is achieved by pulling the plug out of the receptacle. Micro-miniature plug/receptacle electrical connectors are used in widely diverse applications such as computers, instrumentation, radio-controlled equipment, communications and audio equipment, etc.

Generally the electrically conductive contacts of both the plug and the receptacle are supported in a dimensionally stable, electrically insulative material. This insulator electrically separates the various contacts and further aligns the various contacts for ready connection and disconnection. In some circumstances, it is desired the insulator be an insulative "insert" itself supported in a metal housing. Metal housings for the insulative insert are particularly desired to shield the contacts from electromagnetic interference and radio frequency interference. Metal housings can be brazed or welded to a support structure, or if, attached to a support structure with a fastener, provide more sturdiness and can withstand higher compressive forces than plastic housings. Metal housings further have a low coefficient of thermal expansion.

In certain situations it is desired that either the plug or the receptacle be "hermetically" sealed, i.e., sealed so as to be relatively air-tight. A hermetic seal can be defined as one which leaks less than $10^{-5}$ cubic centimeters of helium per second at a 1 atmosphere pressure differential ($cc_{He}$/sec-atm). Hermetically sealed connectors are particularly used when it is necessary to maintain a controlled environment on one side of the seal. The controlled environment might be, for example, an inert gas such as nitrogen or argon, another type of controlled fluid such as FLUORINERT manufactured by 3M Corp. of St. Paul, Minn., or merely a clean (i.e. dust free) air environment.

Previously, it has been difficult to effectively produce hermetically sealed electrical connectors, particularly at low cost and able to withstand significant thermal cycling. Conventional sealing methods and sealants have generally been found to be ineffective in creating a long-lasting hermetic seal between metallic housings and glass, ceramic or plastic inserts, particularly when the seal must undergo thermal cycling. Part of the problem is that coefficients of thermal expansion may differ significantly between the metal of the housing and/or the contacts, the insulative glass, ceramic or plastic insert, and the sealant material. Thermal cycling causes unequal expansion and contraction between the various components, which has lead to an unacceptable rate of seal failure.

Because consistent plastic/metal hermetic seals have not yet been attainable, other materials have been required for hermetically sealed electrical conductors. Connectors have been built using glass-to-metal or ceramic-to-metal joining techniques, using a glass or ceramic insulator around each of the electrical contacts. Thermal cycling of these insulators may result in micro-cracks thereby causing leakage, and electrical conductors using glass insulators are not consistently effective for hermetic sealing applications undergoing thermal cycling. The glass-to-metal and ceramic to metal manufacturing processes are further technologically complex and relatively expensive. For example, these manufacturing processes may require use of an alloy such as KOVAR to create the hermetic seal. Various other sealing methods, such as using grommets, gaskets and O-rings have been attempted for application to electrical connectors. These sealing methods generally require an axial compressive force which is both controlled and consistent, and further add cost to the design and manufacturing processes.

Prior art methods of sealing electrical connectors have a high incidence of failure and may require reworking of the electrical connector. Accordingly, it is desired to develop a method of hermetically sealing an electrical connector which is applicable to connectors having a metal housing around an insulative insert.

SUMMARY OF THE INVENTION

The present invention achieves hermetic sealing of an electrical connector which is applicable to connectors having a metallic housing about an insulative insert. Both the seal area of the housing and the seal surface of the insulative insert are roughened such as by grit blasting. After this roughening, both the seal area of the housing and the seal surface of the insert are cleaned, preferably by rinsing. The seal area of the housing is primed with a primer, and the primer is dried prior to assembly of the insert and the electrically conductive contacts within the housing. After assembly, the seal area of the housing and the seal surface of the insulative insert are sealed to each other and around the electrically conductive pins with a sealant.

While the above-identified drawing figures set forth one embodiment of the present invention, other embodiments are also contemplated, some of which are noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

DETAILED DESCRIPTION OF THE PREFERRED EMBODIMENT

Figure 1:
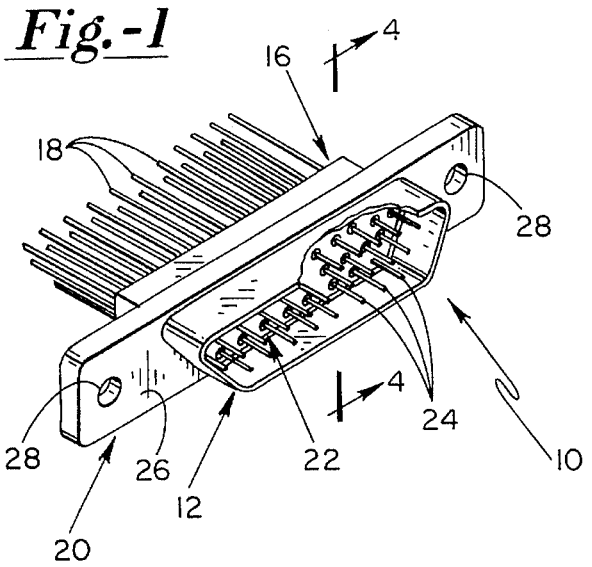
FIG. 1 is a perspective view of a receptacle.

FIG. 1 shows receptacle 10 which can be hermetically sealed according to the present invention. Receptacle 10 generally has a connection side 12 for connection and disconnection with plug 14 of FIG. 2. Opposite connection side 12, receptacle 10 has a lead side 16 for permanent connection to leads 18 of the receptacle device. Receptacle 10 includes housing 20, insert 22, and contacts or pins 24 extending through insert 22.

Housing 20 is shown with flange 26 and flange holes 28. Flange 20 and flange holes 28 allow housing 20 to be easily attached to a wall 30 or surface of a device (shown in FIG. 4). Housing 20 can be made out of any type of dimensionally stable material, but is most beneficially made of metal. As explained above, a metal housing 20 will help shield contacts 24 from electromagnetic interference and radio frequency interference. Metal housing 20 further provides sturdiness, is easily manufactured, and has a low coefficient of thermal expansion. Housing 20 can be, for instance, made of machined aluminum, stainless steel, KOVAR (an alloy of nickel and stainless steel), brass, copper or other metal. Housing 20 may be coated with another material or metal, as desired. Workers skilled in the art will appreciate that housing 20 can be shaped as desired and can be made from any dimensionally stable material desired to fulfill the needs of the overall design.

Housing 20 should be shaped so that it supports insulative insert 22 in a fixed position. Insert 22 must be made out of an insulative material such that no electrical contact is made between individual pins 24. For instance, insert 22 may be made of injection molded plastic such as RYTON, a polyphenylene sulfide ("PPS") manufactured by Phillips 66 Co. of Bartlesville, Okla., or of diallyl phthalate, commonly referred to as DAP. Insert 22 may also be made of other plastics, glass, or other non-conductive material.

Figure 2:
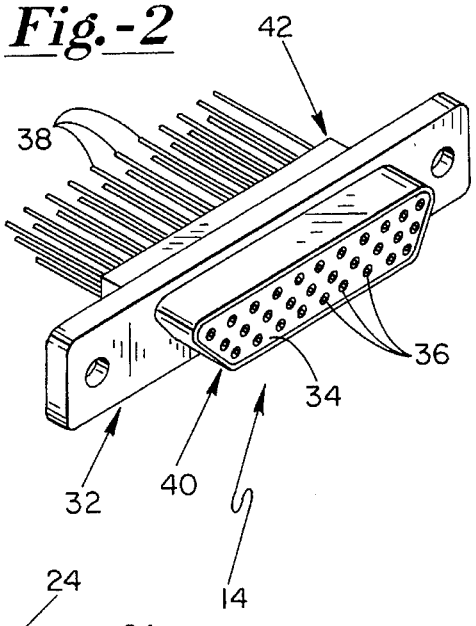
FIG. 2 is a perspective view of a plug to be received in the receptacle of FIG. 1.

FIG. 2 shows the plug 14 for use with receptacle 10 of FIG. 1. Plug 14 is constructed similarly to receptacle 10, having a plug housing 32, a plug insert 34, a plurality of male pins 36, and a lead 38 extending from each of the male pins 36. Plug 14 thus also has a connection side 40 and a lead side 42. Male pins 36 mate with the female pins 24 of receptacle 10 when plug 14 and receptacle 10 are operably connected.

Figure 3:
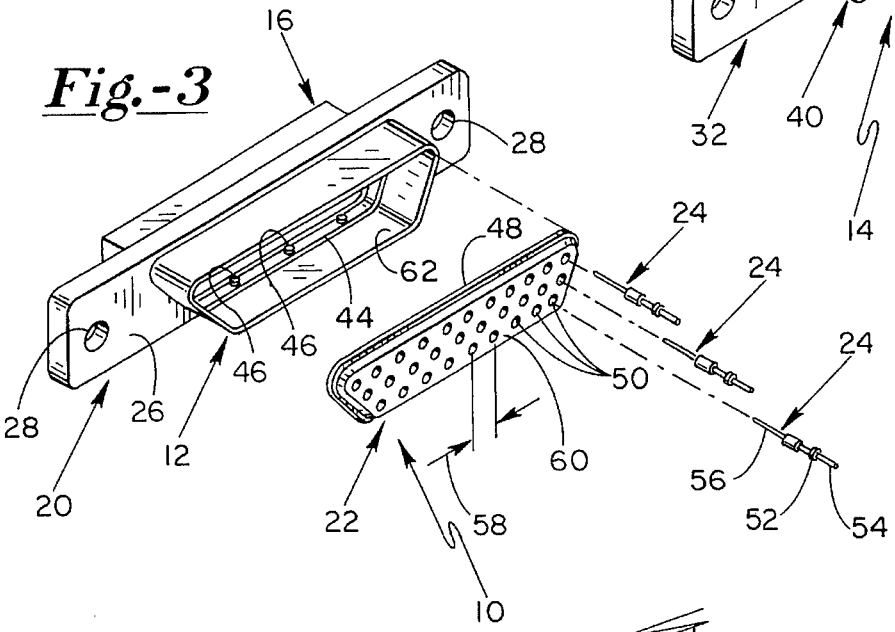
FIG. 3 is an exploded perspective view showing assembly of a receptacle.

FIG. 3 shows an exploded view of receptacle 10 of FIG. 1, indicating assembly of receptacle 10. Housing 20 has an internal shoulder 44 and a plurality of bumps 46 for supporting insert 22 in a fixed position. Insert 22 has an outer profile 48 conforming to the internal shoulder 44 of housing 20. Bumps 46 allow insert 22 to be snapped into place within housing 20. Workers skilled in the art will recognize that other configurations can be used to consistently locate insert 22 within housing 20. For instance, housing 20 may be configured to allow insert 22 to be placed into housing 20 either from the connection side 12 or from the lead side 16.

Insert 22 may have a number of holes 50 therethrough which independently support and separate pins 24 in receptacle 10. Pins 24 may have a shoulder 52 which allows them to be accurately positioned and retained within holes 50. Pins 24 may be made of gold-plated beryllium copper or other electrically conductive material. The female configuration for connection end 54 of pins 24 may be achieved by a hollow cylindrical tube shape as shown, or by other shapes allowing readily connected and disconnected contact with the male pins 36 of the plug 14. Lead end 56 of pins 24 may have an attachment for soldering, crimping, or otherwise attaching to electrical leads 18 in the receptacle device. Leads 18 may be initially attached to pins 24 prior to assembly and sealing or may be attached to pins 24 after receptacle 10 is assembled and sealed. For some uses, it may be beneficial not to attach leads 18 at all, and rather assemble receptacle 10 for removeable connection on both sides. Spacing 58 between pins 24 may be large or small as appropriate for the electrical voltage carried by pins 24.

While plug 14 and receptacle 10 are shown with three linear rows of pins 24, the present invention is applicable with any number of pins and any configuration thereof. Insert 22 and pins 24 can also be configured in other ways as desired for insert 22 to support pins 24. For instance, pins 24 can be inserted into insert 22 from the connection side 12 rather than from the lead side 16 as shown.

A seal surface 60 is defined on insert 22 as the surface which subsequently will be sealed or be in contact with sealant. The seal surface 60 may be on either the connection side 12 or the lead side 16 of receptacle 10, depending upon where the sealant is desired to be located. Placement of the seal on the lead side 16 will, in most applications, have the sealant contact the controlled environment. Exposing the seal to the controlled environment will often provide better conditions to maintain the seal. In locating the seal on the lead side 16 of receptacle 10, the sealant is also less likely to undergo physical abuse during repeated attachment and detachment of plug 14 and receptacle 10. The seal could alternatively be applied to the connection side 40 or the lead side 42 of the plug 14. A seal area 62 is defined on housing 20 as the surface which will be sealed immediately adjacent the seal surface 60 of insert 22.

Figure 4:
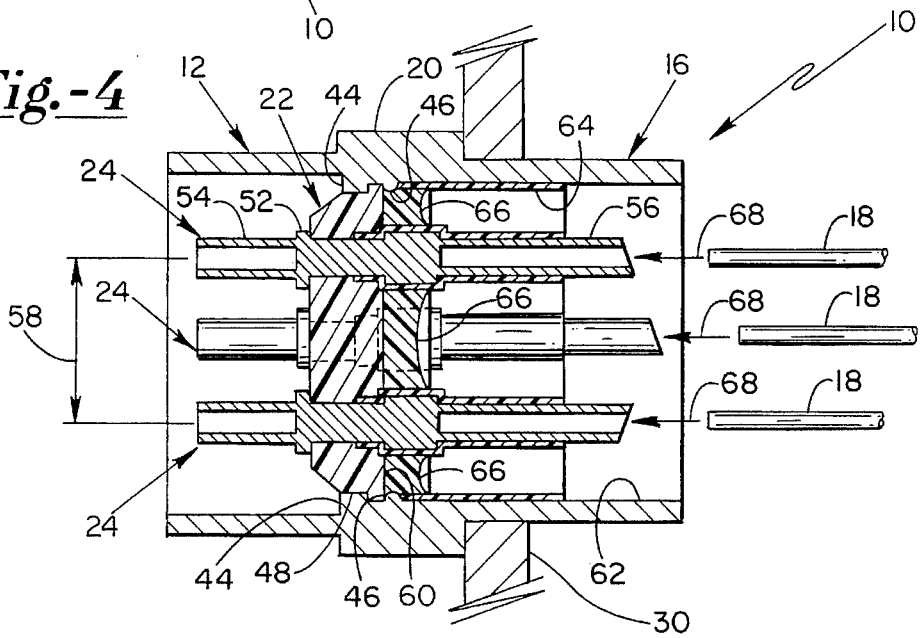
FIG. 4 is a greatly enlarged cross-sectional view taken along line 4—4 of FIG. 1, showing the receptacle attached to a wall.

FIG. 4 shows a greatly enlarged cross-sectional view taken along line 4—4 of FIG. 1, showing receptacle 10 attached to wall 30. FIG. 4 indicates a receptacle 10 fully assembled according to the present invention, including layers of primer 64 and sealant 66. Leads 18 are shown with arrows 68 directing leads 18 into lead ends 56 of pins 24. Lead ends 56 of pins 24 may then be crimped or soldered to attach to leads 18. Seal housing 20 may be sealed to wall 30 by any method known in the art, including soldering, welding, brazing, or by using an additional seal mechanism (not shown) such as a gasket, adhesive or O-ring. Plug 14 would be similar in cross-sectional view except that the connection side 40 of pins 36 would be male rather than female.

Figure 5:
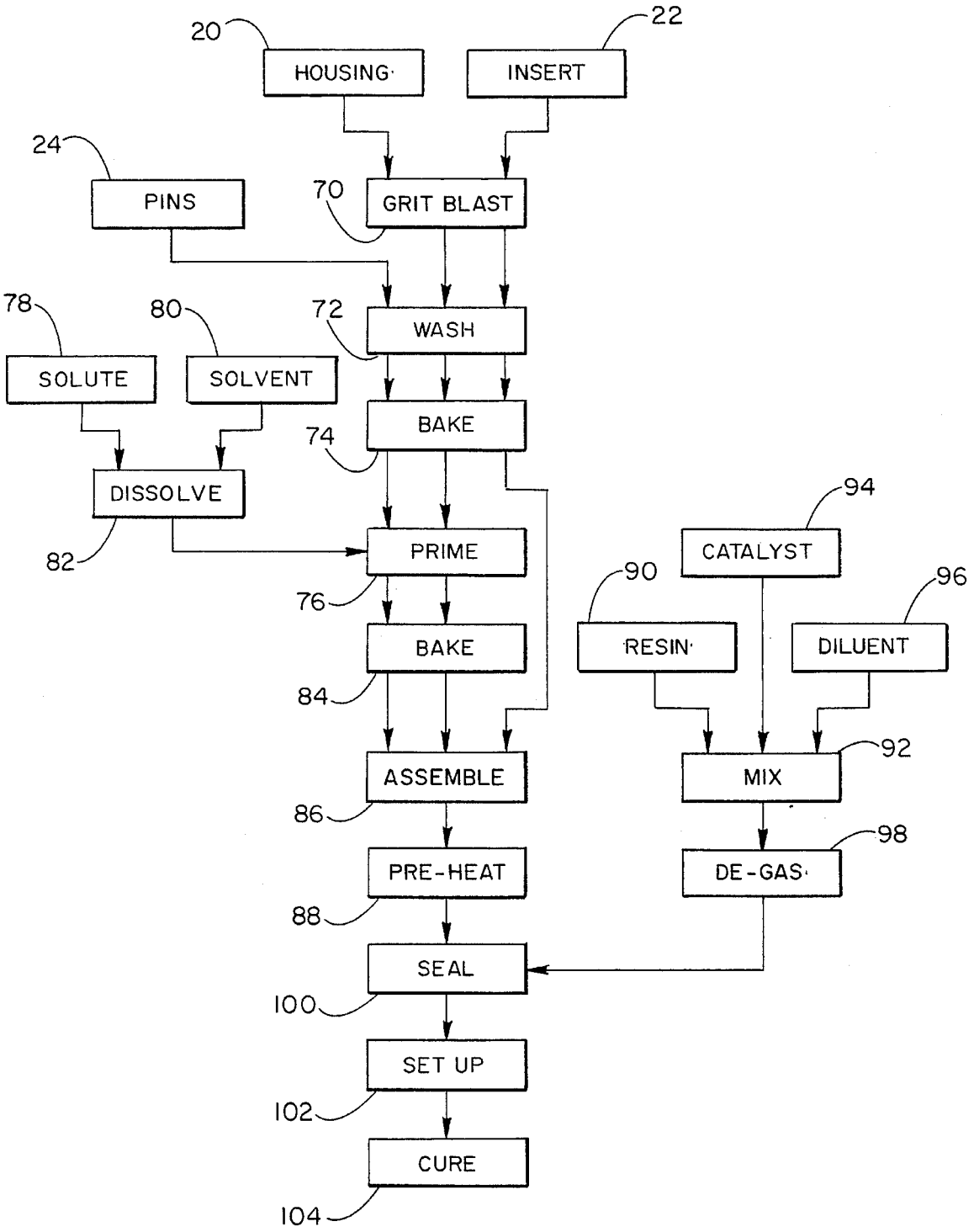
FIG. 5 is a schematic diagram indicating the various steps for use with the preferred embodiment of the present invention.

The sealing method of the present invention will be described with regard to the schematic shown in FIG. 5. As shown by step 70, the seal surface 60 of insert 22 and the seal area 62 of housing 20 are roughened or abraded. This roughening is preferably achieved by grit-blasting or sand-blasting. The particle size used for the grit-blasting should be from 20–80 microns in diameter, preferably about 50 microns in diameter. Suitable micro-blasters are manufactured by Comco Corp. of Burbank, Calif. and by S. S. White Industrial Products Division of Pennwalt Corp., Piscataway, N.J. The grit-blasting should be carded out at low pressures such as 20–30 psi, but can be performed at pressures up to 70–80 psi.

Roughening step 70 should be continued for sufficient duration to roughen the entire seal area 62 of housing 20 as well as the entire seal surface 60 of insert 22. If housing 20 is plated, the roughening step 70 should be continued for a duration sufficient to remove any plating from seal area 62, particularly if the plating is made of nickel or similar metal which is difficult to properly prime. Housing 20 may also have plating in the form of a treated layer, such as through anodizing or cadmium or other chemical treatment in an acidic solution, and this plating may similarly be removed during roughening step 70. If insert 22 is injection molded, the roughening step 70 should be continued for a duration sufficient to completely remove any injection molded "skin", i.e., to remove the smooth outer surface layer caused by injection molding. It is generally unnecessary to roughen the surface of pins 24. It is believed that the small circumference of the pins allows the sealant to maintain a stronger, more durable seal relative to the forces withstood, particularly for pins 24 with gold plating.

After roughening step 70, both the seal surface 60 and the seal area 62 should be cleaned, as indicated by step 72. A number of different methods may be employed for cleaning step 72, including blowing any dust away with compressed air or plasma cleaning. However, it is preferred that the seal surface 60 of insert 22 and the seal area 62 of the housing 20 be washed or rinsed, to carry away any potential contaminants remaining after roughening. The rinse is preferred to be distilled water, but could also be deionized water, isopropyl alcohol, or acetone. Multiple rinses may be performed using any of the above rinses or combinations thereof. While it is not necessary, pins 24 may also be cleaned with housing 20 and insert 22. Its important to maintain cleanliness after the initial wash until the manufacture process is complete.

As indicated by step 74, the cleaned components should then be dried. This drying can be achieved by baking the components in an air circulating oven or a vacuum oven at 80°–105° C. for a least 30 minutes. Such drying is necessary before continuing to the priming process 76.

The next step 76 in forming the hermetic seal is to apply primer to the metal components, particularly housing 20. The primer solute 78 should be either a silane, a titanate, or a zirconate, all of which are available from Dow Chemical Co. of Midland, Mich., from Union Carbide Corp. of Danbury, Conn., and from E. I. DuPont de Nemours & Co. of Wilmington, Del. The preferred primer is a 0.3% to 1% solution of silane dissolved in a solvent 80, as indicated by step 82. The solvent 80 can either be distilled water, deionized water, isopropyl alcohol, or methanol. Housing 20 may be dipped into the primer, or primer may be sprayed on or otherwise applied to the seal area 62 of housing 20. Primer may also be applied around the sealing portion of each of the pins 24.

After priming 76, the primed components should be oven baked at 50°–80° C. for about ½ hour, as indicated by step 84. Sufficient drying will also occur in room temperature conditions by allowing a full hour of air drying.

As indicated by step 86, the components should now be assembled. First insert 22 should be pressed into housing 20 past bumps 46 such that it snaps into place. Pins 24 are then individually placed into holes 50 in insert 22 and properly aligned.

After assembly 86, the entire receptacle 10 should be pre-heated to 60°–90° C. The sealant 66 may be similarly pre-heated to 60°–80° C. for 15 to 30 minutes prior to application. The pre-heating step 88 promotes sealant 66 flow around the tightly toleranced corners around the pins 24 and between the seal surface 60 and seal area 62. The pre-heat step 88 also allows sealant 66 to better wet the surface of pins 24 and seal surface 60 and seal area 62. Without sufficient pre-heating of receptacle 10, the sealant 66 may be too viscous to set up or flow uniformly and properly seal across the entire seal surface 60 and seal area 62.

The sealant 66 should be a viscous material with particle filling that stays in suspension throughout the process. If the seal is to undergo thermal cycling, it is believed that a sealant 66 with a high glass transition temperature and a low coefficient of thermal expansion will provide a more durable hermetic seal. The preferred sealant 66 begins with an epoxy-based resin 90 filled with either alumina or aluminum nitride particles. The particle filling helps to reinforce the epoxy and add dimensional stability to the sealant. STYCAST 2850-FT, manufactured by Emerson & Cuming, Inc. of Woburn, Mass. has been found to be a suitable epoxy-based resin 90. As indicated by step 92, the resin 90 is mixed with catalyst 94 and perhaps with a reactive diluent 96 to form sealant 66. CAT 11, also manufactured by Emerson & Cuming, Inc., has been found to be a suitable catalyst, when mixed with STYCAST 2850-FT at about twice the recommended proportion. INSULCAST 141W is also a suitable resin 90 when used with a catalyst 94 of INSULCURE B or C, all available from Permagile Industries Inc. of Plainview, N.Y. The reactive diluent 96 is added to maintain sealant 66 at a sufficiently low viscosity. A suitable reactive diluent 96 is available from Dow Chemical Co. of Midland, Mich. as DER-736.

As indicated by step 98, after the components of the sealant 66 are mixed, sealant 66 is degassed in a vacuum chamber. This can be achieved by drawing a vacuum of 1 to 5 Torr across the mixed sealant 66 for a time of 2–5 minutes. Degassing step 98 can also be performed after the sealant 66 has been applied to the receptacle 10. It is believed that degassing helps to draw bubbles out of the sealant 66, and that such bubbles may lead to seal breakdown during thermal cycling if left within the sealant 66. Particularly for micro-connectors with dense spacing 58 of pins 24, bubbles trapped within the sealant 66 may further cause shorting or arcing between pins 24.

As indicated by step 100, the degassed sealant 66 is applied to the seal surface 60 of insert 22 and to the seal area 62 of housing 20. A micro-dispenser may be used to place sealant 66 around all the pins 24 and comers of seal area 62 of housing 20.

After applying sealant 66, the next step 102 is to allow sealant 66 to setup or flow and level off for a period of time. A suitable setup step 102 may include setup of 1 hour at room temperature, followed by oven heating of 70°–85° C. for 2–4 hours. It is believed that the set-up step 102 allows the alumina or aluminum nitride particles to remain evenly dispensed throughout the sealant during the entire sealing/curing process. Without the set-up step 102, the particles may settle out if immediately exposed to the elevated temperature of the curing process.

The final step 104 is to complete the cure of the sealant 66. The preferred final oven cure 104 is performed at 120°–125° C. for 2–8 hours. The elevated temperature cure helps to build strength and seal integrity throughout the sealant 66.

The present inventive method avoids the prior art problems of metal to glass and metal to ceramic joining, while retaining the advantages of a metallic housing. The present invention allows metallic housing connectors with plastic inserts to be hermetically sealed without greatly added expense, and further provides a hermetic seal which has excellent resistance to seal breakdown due to thermal cycling.

The preferred STYCAST/CAT 11 sealant 66 described has a coefficient of thermal expansion of about $17\times10^{-6}$ inch/inch/°F. The INSULCAST/INSULCURE sealant 66 described has a coefficient of thermal expansion of about $16\times10^{-6}$ inch/inch/°F. The preferred aluminum housing 20 has a coefficient of thermal expansion of about $13\times10^{-6}$ inch/inch/°F. The preferred RYTON insert 22 has a coefficient of thermal expansion of about $13\times10^{-6}$ inch/inch/°F. With these thermal expansion coefficients, electrical connectors manufactured according to the method of this invention have been leak tested and produced results on the order of $10^{-8}$ to $10^{-9}$ $cc_{He}$/sec-atm. These results far exceed the $10^{-5}$ $cc_{He}$/sec-atm required for hermeticity, and are better than previously believed achievable for metal housing connectors with plastic inserts.

Although the present invention has been described with reference to preferred embodiments, workers skilled in the art will recognize that changes may be made in form and detail without departing from the spirit and scope of the invention.

What is claimed is:

1. A process for hermetically sealing an electrical connector, the electrical connector having a plurality of electrically conductive pins, an insulative insert having a seal surface, the insulative insert for supporting the electrically conductive pins through the seal surface, and a housing for supporting the insulative insert, the housing having a seal area adjacent the supported insulative insert, the process comprising:

roughening the seal area of the housing;

roughening the seal surface of the insulative insert;

cleaning the seal area of the housing and the seal surface of the insulative insert;

priming the seal area of the housing with a primer;

assembling the electrically conductive pins within the insulative insert and the insulative insert within the housing, thereby forming an assembled electrical connector; and sealing the seal area of the housing and the seal surface of the insulative insert with a sealant.

2. The process for hermetically sealing an electrical connector of claim 1, wherein the roughening steps are performed by grit-blasting the housing and the insulative insert.

3. The process for hermetically sealing an electrical connector of claim 2, wherein the grit-blasting is performed with particles of 20 to 80 microns diameter and at pressure of 20 to 40 psi.

4. The process for hermetically sealing an electrical connector of claim 1, wherein the housing is plated, wherein the roughening of the seal area of the housing removes plating from the seal area of the housing.

5. The process for hermetically sealing an electrical connector of claim 1, wherein the insulative insert has an injection molding skin, wherein the roughening of the seal surface of the insulative insert removes the injection molding skin from the seal surface of the insulative insert.

6. The process for hermetically sealing an electrical connector of claim 1, wherein the cleaning step is performed by washing the seal area of the housing and the seal surface of the insulative insert.

7. The process for hermetically sealing an electrical connector of claim 6, wherein the washing step is performed with a rinse selected from the group consisting essentially of:

distilled water, deionized water, isopropyl alcohol and acetone.

8. The process for hermetically sealing an electrical connector of claim 6, further comprising the step of:

drying the washed housing and the washed insulative insert by baking the washed housing and the washed insulative insert at an elevated temperature.

9. The process for hermetically sealing an electrical connector of claim 1, further comprising the step of:

cleaning the electrically conductive pins.

10. The process for hermetically sealing an electrical connector of claim 1, wherein the primer is a solution comprised of 0.3 to 1% solute in a solvent, wherein the solute is selected from the group consisting essentially of:

silanes, titanates and zirconates;

and wherein the solvent is selected from the group consisting essentially of:

distilled water, deionized water, isopropyl alcohol and methanol.

11. The process for hermetically sealing an electrical connector of claim 1, further comprising the step of:

drying the primed housing prior to the sealing step by baking the primed housing at an elevated temperature.

12. The process for hermetically sealing an electrical connector of claim 1, further comprising the step of:

pre-heating the assembled electrical connector prior to the sealing step.

13. The process for hermetically sealing an electrical connector of claim 1, further comprising the step of:

pre-heating the sealant prior to the sealing step.

14. The process for hermetically sealing an electrical connector of claim 1, wherein the sealant comprises:

an epoxy-based alumina-filled resin; and a catalyst mixed with the epoxy-based alumina-filled resin.

15. The process for hermetically sealing an electrical connector of claim 14, wherein the sealant further comprises:

a reactive diluent to lower sealant viscosity.

16. The process for hermetically sealing an electrical connector of claim 1, further comprising the steps of:

degassing the sealant in a vacuum; and curing the sealant.

17. The process for hermetically sealing an electrical connector of claim 1, further comprising the steps of:

allowing the sealant to set-up at a lower temperature; and subsequently curing the sealant at an elevated temperature.

* * * * *

UNITED STATES PATENT AND TRADEMARK OFFICE

CERTIFICATE OF CORRECTION

PATENT NO. : 5,535,512

DATED : JULY 16, 1996

INVENTOR(S) : LLOYD ARMOGAN

It is certified that error appears in the above-indentified patent and that said Letters Patent is hereby corrected as shown below:

Col. 4, line 62, delete "carded", insert --carried--

Col. 6, line 45, delete "comers", insert --corners--

Signed and Sealed this

Twenty-ninth Day of October 199(

*Attest:*

Bruce Lehman

BRUCE LEHMAN

*Attesting Officer*

*Commissioner of Patents and Trademarks*